US005285215A

United States Patent [19]

Liker

[11] Patent Number: 5,285,215

[45] Date of Patent: Feb. 8, 1994

[54] INK JET APPARATUS AND METHOD OF OPERATION

[75] Inventor: Stephen J. Liker, Danbury, Conn.

[73] Assignee: Exxon Research and Engineering Company, Florham Park, N.J.

[21] Appl. No.: 117,351

[22] Filed: Oct. 27, 1987

Related U.S. Application Data

[63] Continuation of Ser. No. 857,517, Apr. 22, 1986, abandoned, which is a continuation of Ser. No. 453,295, Dec. 27, 1982, abandoned.

[51] Int. Cl.[5] ..... B41J 2/045

[52] U.S. Cl. ..... 346/1.1; 346/140 R

[58] Field of Search ..... 346/140, 1.1

[56] References Cited

U.S. PATENT DOCUMENTS

| | | | |
|---|---|---|---|
| 3,683,212 | 8/1972 | Zoltan | 346/140 X |
| 3,846,800 | 11/1974 | Chen | 346/75 X |
| 3,946,398 | 3/1976 | Kyser | 346/140 X |
| 3,947,851 | 3/1976 | Chen | 346/75 X |
| 3,979,756 | 9/1976 | Helinski | 346/75 X |
| 4,068,241 | 1/1978 | Yamada | 346/75 |
| 4,087,825 | 5/1978 | Chen | 346/75 |
| 4,104,646 | 8/1978 | Fischbeck | 346/140 |
| 4,184,168 | 1/1980 | Isayama | 346/140 |
| 4,266,232 | 5/1981 | Juliana | 346/140 |
| 4,312,007 | 1/1982 | Winfield | 346/140 |
| 4,383,264 | 5/1983 | Lewis | 346/140 |
| 4,393,384 | 7/1983 | Kyser | 346/140 X |
| 4,409,596 | 10/1983 | Ishii | 346/140 X |
| 4,418,355 | 11/1983 | DeYoung | 346/140 |
| 4,424,521 | 1/1984 | Lewis | 346/140 |
| 4,459,601 | 7/1984 | Howkins | 346/140 |
| 4,468,679 | 8/1984 | Suga | 346/140 |
| 4,471,363 | 9/1984 | Hanaoka | 346/140 |
| 4,491,851 | 1/1985 | Mizuno | 346/140 X |
| 4,503,444 | 3/1985 | Tacklind | 346/140 |
| 4,509,059 | 4/1985 | Howkins | 346/140 X |
| 4,513,299 | 4/1985 | Lee | 346/140 |
| 4,523,200 | 6/1985 | Howkins | 346/1.1 |
| 4,523,201 | 6/1985 | Liker | 346/140 X |

*Primary Examiner*—Joseph W. Hartary

*Attorney, Agent, or Firm*—Woodcock Washburn Kurtz Mackiewicz & Norris

[57] ABSTRACT

A method for controlling the boldness of printing via control of the number of ink droplets ejected from a drop on demand ink jet apparatus for producing each ink dot upon a recording medium, the apparatus including at least one transducer operable for producing a pressure disturbance within an associated ink chamber for ejecting an ink droplet from an associated orifice the method comprising the steps of operating the transducer in an iterative manner for selectively producing a predetermined plurality of successively equal or higher or lower amplitude pressure disturbances within the ink chamber, or some combination thereof, for causing a predetermined plurality of successively equal or higher or lower velocity ink droplets, or some combination thereof, to be ejected from the orifice of the ink jet apparatus, within a time period permitting the ink droplets to either merge in flight or upon striking a recording medium, thereby controlling the size of the "ink spot" so printed upon the recording medium.

9 Claims, 4 Drawing Sheets

INK JET APPARATUS AND METHOD OF OPERATION

This is a continuation of application Ser. No. 857,517, filed Apr. 22, 1986 abandoned, which is a continuation of application Ser. No. 453,295, filed Dec. 27, 1982 abandoned.

BACKGROUND OF THE INVENTION

Field of Invention

The field of the present invention relates generally to ink jet apparatus, and more specifically to a method for operating an ink jet apparatus for providing selective control within a range of either the volume of the ink droplets ejected by the apparatus and/or the amount of ink striking a desired point on a recording medium.

The design of practical ink jet devices and apparatus for producing a single droplet of ink on demand is relatively new in the art. In prior drop on demand ink jet apparatus, the volume of each individual ink droplet is typically dependent upon the geometry of the ink jet apparatus, the type of ink used, and the magnitude of the pressure force developed within the ink chamber of the ink jet rejecting an ink droplet from an associated orifice. The effective diameter and design of the orifice, the volume and configuration of the ink chamber associated with the orifice, the transducer design, and the method of coupling the transducer to the ink chamber, are all factors determining the volume of individual ink droplets ejected from the orifice. Typically, once the mechanical design of an ink jet apparatus is frozen, control over the volume of the ejected ink droplets can only be obtained over a narrow range by varying the amplitude of the electrical pulses or dry voltage applied to the individual transducers of the ink jet apparatus or array.

The present inventor discovered that by operating the transducer of an ink jet in an iterative manner, for causing a plurality of successively higher, lower, or equal velocity ink droplets, or some combination thereof, to be ejected from the orifice of the ink jet, within a time period permitting the droplets to either merge in flight prior to striking a recording medium, or upon striking the recording medium at the same point, that broader control of the boldness and toning of printing could be obtained. The volume of ink striking a recording medium at a given point is thereby partly determined by the number of ink droplets merged prior to striking or at the point of striking.

In the drawing, wherein like items have common reference designations:

In FIGS. 1 through 5, an ink jet apparatus of copending application Ser. No. 336,603, now U.S. Pat. No. 4,459,601, filed Jan. 4, 1982, for "Improved Ink Jet Method and Apparatus" is shown (the invention thereof is assigned to the assignee of the present invention), and incorporated herein by reference. The present invention was discovered during development of improved methods for operating the previously mentioned ink jet apparatus. However, the present inventor believes that the various embodiments of his invention illustrated and claimed herein are applicable for use with a broad range of ink jet apparatus (especially drop on demand ink jet apparatus). Accordingly, the ink jet apparatus to be discussed herein is presented for purposes of illustration of the method of the present invention, and is not meant to be limiting. Also, only the basic mechanical features and operation of this apparatus are discussed in the following paragraphs, and reference is made to the previously mentioned copending application for greater details concerning this apparatus. The reference designations used in FIGS. 1 through 5 are the same as used in the copending application, in order to facilitate any referencing back to that application or the patent that may issue therefrom.

Figure 1:
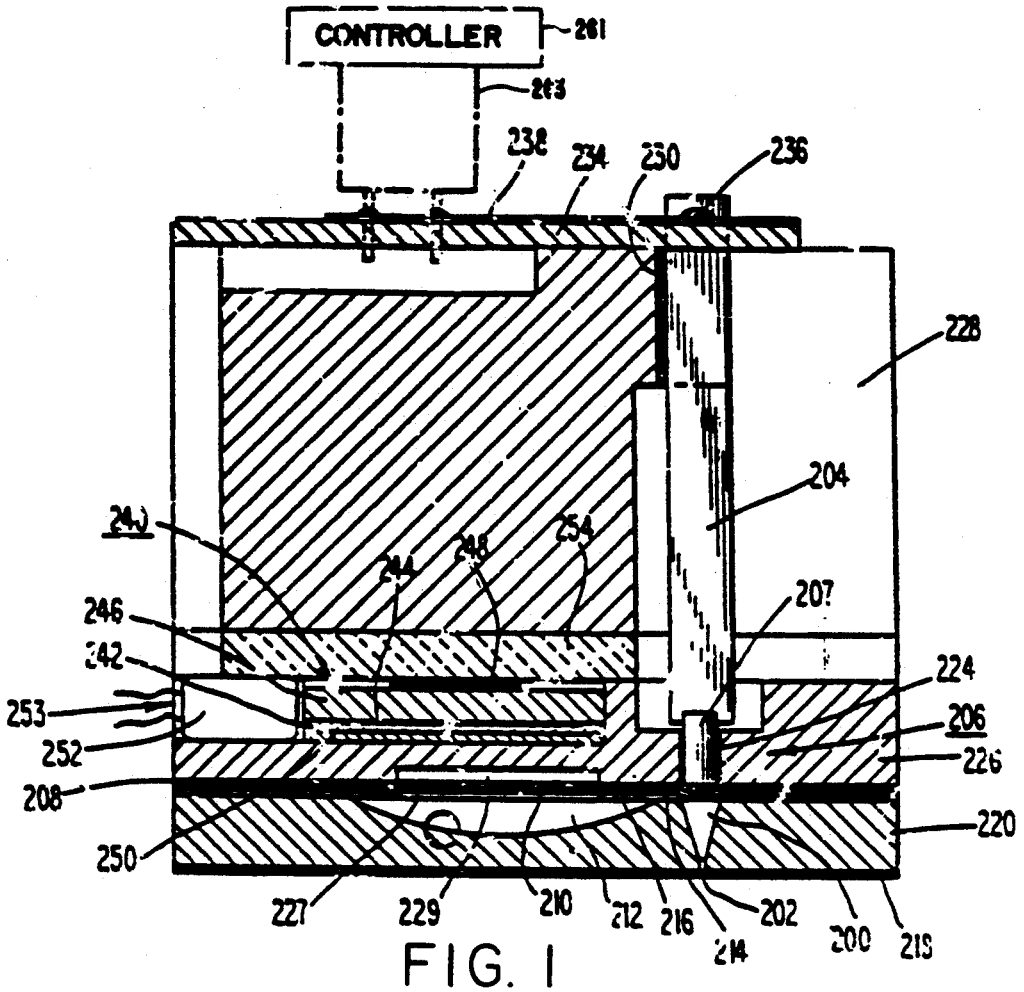
FIG. 1 is a sectional view of an illustrated ink jet apparatus.
Figure 2:
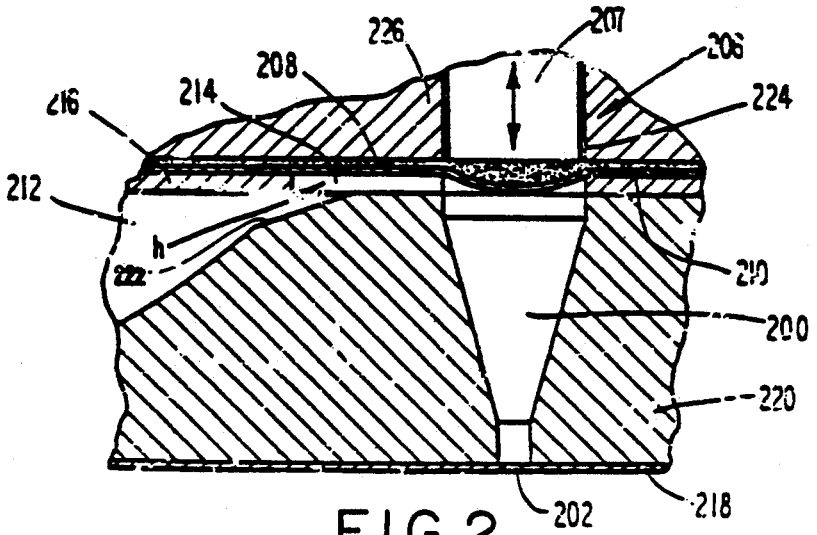
FIG. 2 is an enlarged view of a portion of the section shown in FIG. 1.
Figure 3:
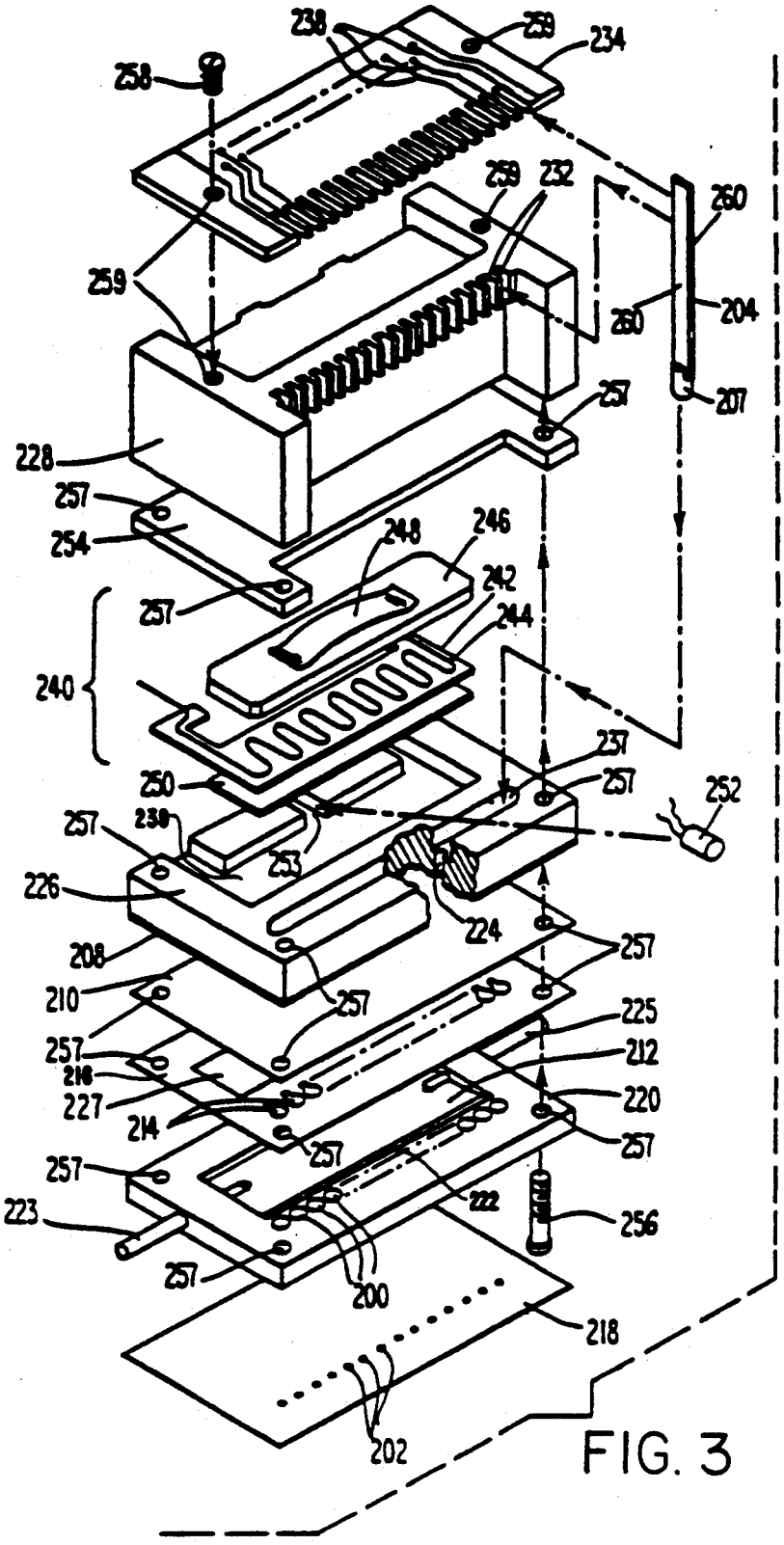
FIG. 3 is an exploded projective or pictorial view of the ink jet apparatus, including the embodiments shown in FIGS. 1 and 2.

With reference to FIGS. 1 through 3, the illustrative ink jet apparatus includes a chamber 200 having an orifice 202 for ejecting droplets of ink in response to the state of energization of a transducer 204 for each jet in an array of such jets (see FIG. 3). The orifice preferably has a cross-sectional dimension in the range of 0.025 mm to 0.075 mm. The transducer 204 expands and contracts (in directions indicated by the arrows in FIG. 2) along its axis of elongation, and the movement is coupled to the chamber 200 by coupling means 206 which includes a foot 207, a visco-elastic material 208 juxtaposed to the foot 207, and a diaphragm 210 which is preloaded to the position shown in FIGS. 1 and 2.

Ink flows into the chamber 200 from an unpressurized reservoir 212 through restricted inlet means provided by a restricted opening 214. The inlet 214 comprises an opening in a restrictor plate 216 (see FIG. 3). As shown in FIG. 2, the reservoir 212 which is formed in a chamber plate 220 includes a tapered edge 222 leading into the inlet 214. As shown in FIG. 3, the reservoir 212 is supplied with a feed tube 223 and a vent tube 225. The reservoir 212 is complient by virtue of the diaphragm 210, which is in communication with the ink through a large opening 227 in the restrictor plate 216 which is juxtaposed to an area of relief 229 in the plate 226.

One extremity of each one of the transducers 204 is guided by the cooperation of a foot 207 with a hole 224 in a plate 226. As shown, the feet 207 are slideably retained within the holes 224. The other extremities of each one of the transducers 204 are compliantly mounted in a block 228 by means of a compliant or elastic material 230 such as silicon rubber. The compliant material 230 is located in slots 232 (see FIG. 3) so as to provide support for the other extremities of the transducers 204. Electrical contact with the transducers 204 is also made in a compliant manner by means of a compliant printed circuit 234, which is electrically coupled by suitable means such as solder 236 to an electrode 260 of the transducers 204. Conductive patterns 238 are provided on the printed circuit 234.

The plate 226 (see FIGS. 1 and 3) includes holes 224 at the base of a slot 237 which receive the feet 207 of the transducers 204, as previously mentioned. The plate 226 also includes a receptacle 239 for a heater sandwich 240, the latter including a heater element 242 with coils 244, a hold down plate 246, a spring 248 associated with the plate 246, and a support plate 250 located immediately beneath the heater 240. The slot 253 is for receiving a thermistor 252, the latter being used to provide monitoring of the temperature of the heater element 242. The entire heater 240 is maintained within the receptacle in the plate 226 by a cover plate 254.

As shown in FIG. 3, the variously described components of the ink jet apparatus are held together by means of screws 256 which extend upwardly through openings 257, and screws 258 which extend downwardly through openings 259, the latter to hold a printed circuit board 234 in place on the plate 228. The dashed lines in FIG. 1 depict connections 263 to the printed circuits 238 on the printed circuit board 234. The connections 263 connect a controller 261 to the ink jet apparatus, for controlling the operation of the latter.

Figure 4:
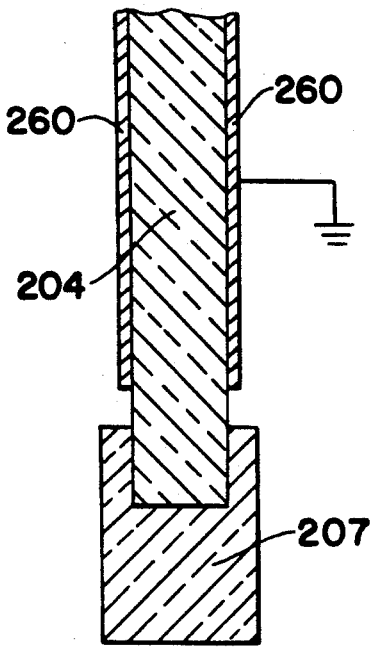
FIG. 4 is a partial sectional/schematic diagram view of the transducer shown in FIG. 1 and 3, with the transducer in the de-energized state.
Figure 5:
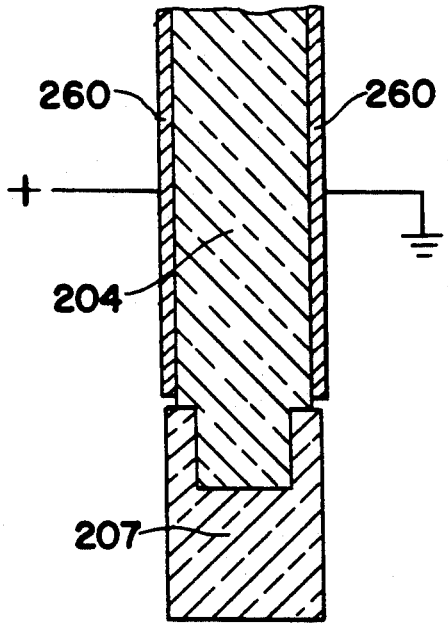
FIG. 5 is a partial sectional/schematic diagram or view of the transducer of FIG. 4 in the energized state.

The controller 261 is programmed to at an appropriate time, via its connection to the printed circuits 238, apply a voltage to a selected one or ones of the hot electrodes 260 of the transducers 204. The applied voltage causes an electric field to be produced transverse to the axis of elongation of the selected transducers 204, causing the transducers 204 to contract along their elongated axis. When a particular transducer 204 so contracts upon energization (see FIG. 5), the portion of the diaphram 210 located below the foot 207 of the transducer 204 moves in the direction of the contracting transducer 204, thereby effectively expanding the volume of the associated chamber 200. As the volume of the particular chamber 200 is so expanded, a negative pressure is initially created within the chamber, causing ink therein to tend to move away from the associated orifice 202, while simultaneously permitting ink from the resevoir 212 to flow through the associated restricted opening or inlet 214 into the chamber 200. Given sufficient time, the newly supplied ink completely fills the expanded chamber and orifice, providing a "fill before fire" cycle. Shortly thereafter, the controller 261 is programmed to remove the voltage or drive signal from the particular one or ones of the selected transducers 204, causing the transducer 204 or transducers 204 to return to their deenergized states as shown in FIG. 4. Specifically, the drive signals are terminated in a step like fashion, causing the transducers 204 to very rapidly expand along their elongated axis, whereby via the visco-elastic material 208 the feet 207 of the transducers 204 push against the area of the diaphram 210 beneath them, causing a rapid contraction or reduction of the volume of the associated chamber or chambers 200. In turn, this rapid reduction in the volume of the associated chambers 200, creates a pressure pulse or positive pressure disturbance within the chambers 200, causing an ink droplet to be ejected from the associated orifices 202. Note that as shown in FIG. 5, when a given transducer 204 is so energized, it both contracts or reduces its length and increases its thickness. However, the increase in thickness is of no consequence to the illustrated ink jet apparatus, in that the changes in length of the transducer control the operation of the individual ink jets of the array. Also note, that with present technology, by energizing the transducers for contraction along their elongated axis, accelerated aging of the transducers 204 is avoided, and in extreme cases, depolarization is also avoided.

Figure 6:
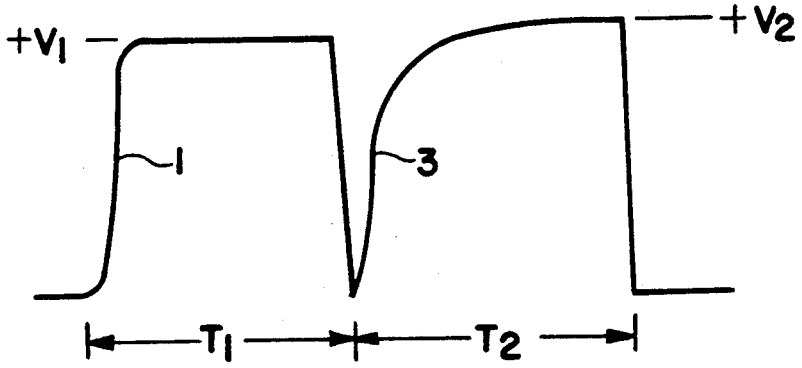
FIG. 6 shows the wave shapes for electrical pulses of one embodiment of the invention.

For purposes of illustration, assume that the pulses shown in FIG. 6 are applied via controller 261 to one of the transducer 204. As shown, the first and second pulses 1 and 3 respectively each have an exponential leading edge and a substantially linear trailing edge, respectively, peak amplitudes $+V_1$, $+V_2$ volts respectively, and pulse widths of $T_1$, $T_2$, respectively. Note that the shapes of the pulses 1,3, respectively, may be other than as illustrated herein, depending upon the particular ink jet device being driven and the particular application. In this example, the peak amplitude plus $+V_2$ of pulse 3 is greater than the peak amplitude $V_1$ of pulse 1, and the fall time for the trailing edge of pulse 3 is less than the fall time for the trailing edge of pulse 1. Since the degree of contraction of the selected transducer 204 is directly related within a range to the amplitude of the pulse applied to the transducer, the greater the amplitude, the greater the degree of contraction. Accordingly, upon termination of a particular operating or control pulse, the magnitude of the pressure disturbance produced in the associated chamber 200 will be directly related within a range to the amplitude of the previously applied control pulse. Also, the greater the slope or the less the fall time of the trailing edge of the control pulse, the more rapid the expansion or elongation of the selected transducer 204 to its rest state upon termination of the control pulse. Correspondingly, the greater the rate of expansion of the transducer 204, the greater the magnitude of the resulting pressure disturbance within the associated chamber 200. Assume that the amplitudes $+V_1$ and $+V_2$ of pulses 1,3, respectively, are large enough to ensure ejection of a ink droplet from associated orifice 202 upon termination of these pulses, respectively.

Figure 9:
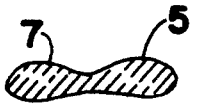
FIG. 9 shows the merging of two ink droplets while in flight.
Figure 7:
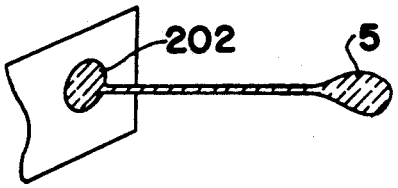
FIG. 7 shows a typical ejection of an ink droplet from an orifice.
Figure 8:
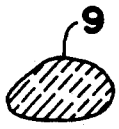
FIG. 8 shows the ejection of an ink droplet from an orifice at a time when the previously ejected ink droplet is still in flight.
Figure 8:
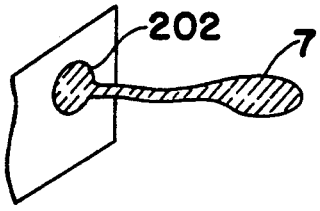
Figure 10:
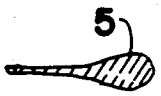
FIG. 10 shows a typical ink droplet formed after the merger of a number of ink droplets just prior to striking a recording medium.

With reference to FIG. 7, assume that pulse 1 is applied to a selected one of transducers 204. Upon termination of pulse 1, a typical ink droplet 5 will be ejected from the associated orifice 202. Substantially upon the termination of pulse 1, assume that pulse 3 is applied to the selected transducer 204. Shortly after the termination of pulse 3, a second ink droplet 7 will be ejected from the associated orifice 202 as shown in FIG. 8, for example. Ink droplet 7 will have a substantially greater velocity than the air-borne ink droplet 5 because the amplitude of pulse 3 is greater of that than pulse 1 and the fall time of pulse 3 is less than that of pulse 1. Note that as previously explained though, the velocity of the second ink droplet 7 will be greater than that of ink droplet 5 so long as at least one of either the amplitude of pulse 3 is greater than that of pulse 1 even if the fall times of these pulses are equal, or the fall time of pulse 3 is less than that of pulse 1 even if their amplitudes are equal. Accordingly, either amplitude control of the control pulses, or trailing edge fall time control of the control pulses or a combination of the two can be used to produce a higher velocity second droplet 7 as illustrated in FIG. 8, for example. By properly controlling the pulse parameters, the velocity of the second ink droplet 7 can be made high enough to cause droplet 7 to catch up with droplet 5 while each is air-borne, causing these droplets to begin to merge together as shown in FIG. 9. Assuming sufficient flight time, the merger of droplets 5 and 7 may result in a droplet shape as shown in FIG. 10 prior to the merged droplets striking a recording medium. Alternatively, depending upon the relative speeds (successively higher or lower) of the droplets and movement of the recording media, the droplets can be made to strike the recording media at the same point or in close enoughness proximity for merger thereon, without merging while air-borne, thereby obtaining the same result. In this manner, the size of the ink droplet or volume of ink striking a recording media at a particular point is substantially increased relative to using only a single droplet, and such control of the volume of ink directly provides control of the boldness of printing. Typical values for the parameters of pulses 1,3 used by the inventor in conducting his experiments, were 28 volts and 30 volts for $+V_1$, $+V_2$, respectively; 60 microseconds for each one of the pulse widths $T_1$ and $T_2$; and fall times of 2 microseconds and 1 microsecond for pulses 1,3, respectively. The viscosity of the ink in this example was 12 centipoise. For the particular ink jet device operated by the present inventor, the approximate diameter of droplet 5 was 1.8 mils, for the second ink droplet 7 was 2.2 mils, and for the merged ink droplet 9 was 4.0 mils. Other ink droplet diameters or volumes may be obtained within a range via control of the amplitudes and fall times of pulses 1 and 3, as previously mentioned.

Within a range, control of the size of ink droplets ejected from the ink jet device can be controlled by adjusting the amplitudes and fall times of the control pulses applied to the ink jet device. The range of control of the volume of ink or ultimate ink droplet size striking a recording media is substantially extended via another embodiment of the present invention for merging a plurality of ink droplets in flight or at the point of striking a recording media.

Figure 11:
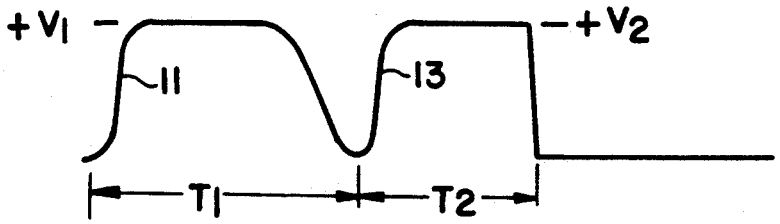
FIG. 11 shows the waveshapes for electrical pulses for another embodiment of the invention.

In FIG. 11, the amplitudes $+V_1$, $+V_2$ of pulses 11, 13, respectively, are shown to be equal (typically 30 volts, for example). In this example, the trailing edge of pulse 11 is about 10 microseconds in fall time, whereas the trailing edge of pulse 13 has a fall time of about 1 microsecond. Accordingly, the ink droplet resulting from the application of pulse 11 to a selected transducer 204 will have a velocity that is substantially slower than the velocity of the following ink droplet resulting from the application of pulse 3 to the transducer 204. Accordingly, only fall time control is being used to adjust the velocities of the ink droplets resulting from the application of pulses 1 and 3. In this example, it is assumed that the second ejected higher velocity ink droplet will merge with the first ejected ink droplet while air-borne or upon striking a recording media, as previously described.

Figure 12:
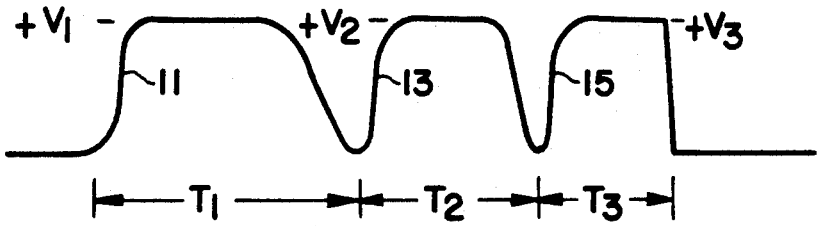
FIG. 12 shows the waveshapes for electrical pulses for yet another embodiment of the invention.

In FIG. 12, a third control or firing pulse 15 has been added following the termination of pulse 13. In one experiment with a given ink jet device, the present inventor set the amplitude of pulses 11, 13, 15 all at 30 volts ($+V_1$, $+V_2$ and $+V_3$ all equal 30 volts), with pulses 11, 13 and 15 typically having exponential fall times of 10 microseconds, 5 microseconds and 1 microsecond, respectively; and pulse widths of 60 microseconds, 40 microseconds and 30 microseconds, respectively, for example. When applied to a selected transducer 204 of the given ink jet device, pulse 11 caused a first ink droplet to be ejected, pulse 13 caused a second ink droplet of greater velocity than the first to be ejected, and pulse 15 caused a third ink droplet of even greater velocity to be ejected, whereby all of these ink droplets were of such relative velocities that they merged in flight prior to striking a recording media. In this manner, an even greater range of control can be obtained for adjusting the size of an ink droplet in an ink jet system. Depending upon the distance of the selected ink jet orifice 202 from the recording medium, the relative speeds of movement of the recording medium and/or the ink jet head, and the design of the particular ink jet device, it is possible that an even greater number of ink droplets can be ejected at correspondingly greater velocities in order to permit merger in flight or at the point of striking or upon striking the recording medium in close proximity, providing even greater control of ink droplet size from one marking position to another on a recording medium.

Note that in practice, an ink droplet is not ejected immediately after the termination of a particular firing pulse. For example, if the pulses 1,3 of FIG. 6 are applied to a transducer 204 of the ink jet device used by the present inventor in his experiments, an ink droplet 5 is ejected 4 microseconds after the termination of pulse 1, and the second ink droplet is ejected 3 microseconds after the termination of pulse 3. The velocity of the first ejected ink droplet was measured to be 3.5 meters per second and of the second ejected ink droplet 5.0 meters per second.

Figure 13:
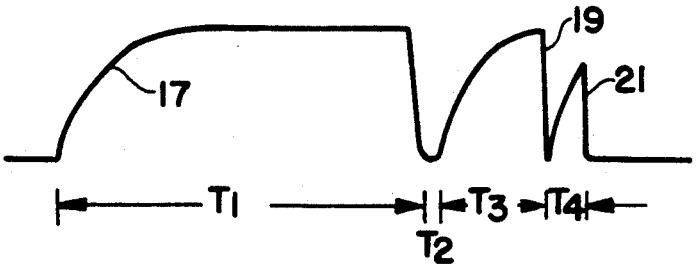
FIGS. 13, 14 an 15 show waveshapes for other embodiments of the invention.

With reference to FIG. 13, the combination of waveshapes shown cause the ink jet apparatus to emit two droplets, which merge at a common point of striking on a print medium to produce dots varying in diameter from 5.3 to 5.6 milliinches, for producing very bold print. Typically, $T_1$, $T_2$, $T_3$, and $T_4$ are 80, 4, 18 and 6 microseconds, respectively, with the amplitudes of pulses 17 and 19 at 110 volts, and pulse 21 at about 73 volts, for producing the previous dot diameter range on a particular type of paper (Hammermill XEROCOPY, manufactured by Hammermill Papers Co., Inc., Erie, Pa.), using an ink having a wax base. The type of paper and ink formulation affects the dot diameter in a given application. Typically, the fall time of pulses 17 and 19 are 9 microseconds and 1.0 microseconds, respectively. Under the conditions indicated above, shortly after termination of pulse 17, a first droplet having a velocity ranging from 8 to 10 meters per second was produced. Also, the combination of pulses 19 and 21, caused a second droplet to be produced about 2 microseconds after the termination of pulse 19. Pulse 21 is not of sufficient amplitude to cause a third droplet to be produced, but does cause the second droplet to breakoff earlier from the orifice of the ink jet relative to operating without pulse 21. Also, pulse 21 permits higher frequency operation of the ink jet apparatus, and reduced ink blobbing problems at the orifice. Using the pulse time periods and amplitudes mentioned above, the velocity of the second droplet is typically 6 to 8 meters per second. The slower velocity of the second droplet relative to the first droplet is caused by the presence of pulse 21. In this example, by increasing the amplitude of pulse 19, the velocity of the second droplet can be increased. Also, by varying the delay time $T_2$ between the termination of pulse 17 and initiation of pulse 19, the boldness can be modulated within a range.

Figure 14:
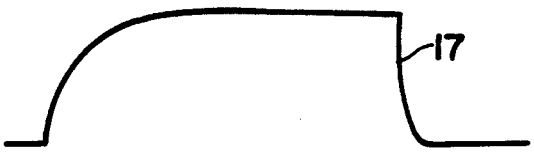

In FIG. 14, by using only pulse 17 to operate the ink jet apparatus, dots having a diameter range of 3.3 to 3.5 milliinches can be obtained. Such dot diameters produce much less bold print relative to operating the ink jet apparatus via the combination of pulses 17, 19, and 21.

Figure 15:
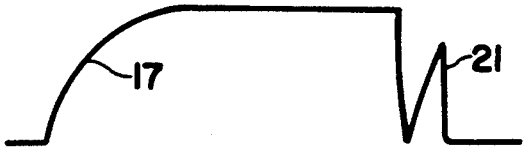

With reference to FIG. 15, the combination of pulses 17 and 21, as shown, operated the ink jet for producing ink droplets having diameters ranging from 2.9 to 3.0 milliinches. This combination produces a very light print. Reference is made co-pending applications Ser. No. 453,571, and Ser. No. 453,291 for "METHOD FOR OPERATING AN INK JET APPARATUS", and "A METHOD FOR IMPROVING LOW-VELOCITY AIMING IN OPERATING AN INK JET APPARATUS", respectively, filed Dec. 27, 1982 and Dec. 27, 1988 respectively, each assigned to the assignee of my present invention, which teach different novel applications of an "early breakoff pulse", such as pulse 21.

By using various combinations of the waveforms of FIGS. 13, 14, and 15, desired shading can be accomplished. Such shading is known as half-toning. Note that with respect to FIG. 13, that although the second droplet is lower in velocity than the first droplet, they are merged at a common point of impact or closely adjacent points of impact upon the print medium.

As previously mentioned, depending upon the relative speeds of the ink droplets, the ink jet head, and the recording medium, the droplets can be made to strike the recording medium at substantially or nearly the same spot or point, and are thereby merged at that point for producing a desired dot size. Accordingly, the shapes of the waveforms used to drive the ink jet apparatus can be designed to cause successively produced ink droplets to have successively higher or lower relative velocities, or some combination thereof, so long as system timing permits the droplets to strike the recording medium at substantially the same point. In this manner, one droplet or a plurality of ink droplets can be selectively chosen for printing a dot of desired boldness at a point on a recording medium.

The controller 261 can be provided via hard-wired logic;, or by a microprocessor programmed for providing the necessary control functions, or by same combination of the two, for example. Note that a Wavetek Model 175 waveshape generator, manufactured by Wavetek, San Diego, California was used by the present inventor to obtain the waveshapes shown in FIGS. 6, 11, 12, 13, 14, and 15. In a practical system, a controller 261 would typically be designed for providing the necessary waveshapes and functions, as previously mentioned, for each particular application.

Although particular embodiments of the present inventive method for operating an ink jet apparatus for extending the range of control of the volume of ink or ink droplet diameter striking a recording media at or closely proximate a given point have been shown and described other embodiments, which fall within the true spirit and scope of the appended claims may occur to those of ordinary skill in the art.

What is claimed is:

1. In a drop on demand ink jet printer including a print head having a plurality of orifices, a plurality of ink chambers each associated with a particular one of said orifices, respectively, and a plurality of transducer means each associated with a particular one of said ink chambers, respectively, said plurality of transducer means each being selectively operable for producing a pressure disturbance within a respective associated ink chamber, for ejecting an ink droplet from an associated orifice, the method comprising the steps of:

(1) operating a selected one of said plurality of transducer means in an iterative manner, for producing a plurality of successive pressure disturbances within an associated ink chamber, for causing a predetermined respective plurality of successively higher velocity ink droplets to all be successively ejected from an associated orifice along the same trajectory, within a time period permitting said droplets to merge while air-borne, thereby controlling the size of the "ink spot" produced by the merged droplets upon striking a print medium, whereupon predetermined relative movement between said print head and said print medium a plurality of "ink spots" are so printed upon said print medium for printing desired images of predetermined boldness.

2. The method of claim 1, further including the step of:

(2) operating simultaneously selected ones of said plurality of transducer means each in the same manner as operating said transducer means of step (1), for ejecting from each one of respective orifices a predetermined number of successively higher velocity ink droplets along the same trajectory within a time period permitting said droplets to merge while air-borne, thereby controlling the boldness of each "ink spot" printed on said print medium during each cycle of printing.

3. The drop-on-demand ink jet printing system of claim 1 in which the cross-sectional dimension of said orifice is within the range of 0.025 to 0.075 mm.

4. A drop-on-demand ink jet printing system comprising an ink jet head having an ink cavity, an orifice communicating with said ink cavity, and an electromechanical transducer mounted in mechanical communication with said ink cavity, a source of electrical drive signals repeatable at a drop-on-demand drop production rate, and means to selectively actuate said electromechanical transducer in response to said electrical drive signals to force a single drop of ink from said orifice; the improvement comprising:

means for selectively producing at least one additional electrical drive signal each with an controlled time delay with respect to the immediately preceding electrical drive signal, said controlled time delay being short with respect to said drop-on-demand drop production rate; and means to actuate said electromechanical transducer with each of said electrical drive signals to produce a quantity of ink having a controlled volume from said orifice, said quantities of ink merging into a single drop of ink prior to the time the drop reaches the print medium for printing whereby each ink drop can be produced having a selected one of a plurality of possible drop sizes.

5. A drop-on demand ink jet printing system comprising an ink jet head having an ink cavity, an orifice communicating with said ink cavity, and an electromechanical transducer mounted in mechanical communication with said ink cavity, a source of electrical drive signals repeatable in said drop-on-demand system, and means to selectively actuate said electromechanical transducer in response to said electrical drive signals to force a single drop of ink from said orifice; the improvement comprising;

means for selectively producing at least one additional electrical drive signal each timed to be applied substantially upon termination of said immediately preceding electrical drive signal, and means to actuate said electromechanical transducer with each of said electrical drive signals to produce a quantity of ink having a controlled volume from said orifice, said quantities of ink merging into a single drop of ink prior to the time the drop reaches the print medium for printing whereby each ink drop can be produced having a selected range of control of drop sizes.

6. In a drop on demand ink jet printer including a print head having a plurality of orifices, a plurality of ink chambers each associated with a particular one of said orifices, respectively, and a plurality of transducer means each associated with a particular one of said ink chambers, respectively, said plurality of transducer means each being selectively operable for producing a pressure disturbance within an associated ink chamber for ejecting a respective ink droplet from an associated orifice, said transducer means operable in an iterative manner for producing plurality of successive pressure disturbances within an associated ink chamber, means for causing a predetermined respective plurality of successively higher velocity ink droplets to all be successively ejected from an associated orifice along the same trajectory within a time period permitting said droplets to merge while air-borne before striking a print medium, and means for predetermined relative movement between said print head and said print medium whereby a plurality of ink spots are printed upon said print medium for printing desired images of predetermined boldness.

7. In a crop-on-demand ink jet printing system comprising an ink jet head having an ink cavity, an orifice communicating with said ink cavity, and an electromechanical transducer mounted in mechanical communication with said ink cavity, a source of electrical drive signals repeatable at a drop-on-demand drop production rate, and means to selectively actuate said electromechanical transducer in response to said electrical drive signals to force a single drop of ink from said orifice; the method comprising the steps of:

selectively producing at least one additional electrical drive signal each with an controlled time delay with respect to the immediately preceding electrical drive signal, said controlled time delay being short with respect to said drop-on-demand drop production rate; and actuating said electromechanical transducer with each of said electrical drive signals to produce a quantity of ink having a controlled volume from said orifice, said quantities of ink merging into a single drop of ink prior to the time the drop reaches the print medium for printing whereby each ink drop can be produced having a selected one of a plurality of possible drop sizes.

8. In a drop-on-demand ink jet printing system comprising an ink jet head having an ink cavity, an orifice communicating with said ink cavity, and an electromechanical transducer mounted in mechanical communication with said ink cavity, a source of electrical drive signals repeatable in said-drop-on-demand system, and means to selectively actuate said electromechanical transducer in response to said electrical drive signals to force a single drop of ink from said orifice; the method comprising the steps of:

selectively producing at least one additional electrical drive signal each timed to be applied substantially upon termination of said immediately preceding electrical drive signal, and actuating said electromechanical transducer with each of said electrical drive signals to produce a quantity of ink having a controlled volume from said orifice, said quantities of ink merging into a single drop of ink prior to the time the drop reaches the print medium for printing whereby each ink drop can be produced having a selected range of control of drop sizes.

9. In a drop-on-demand ink jet printing system comprising an ink jet having an ink cavity, an orifice communicating with said ink cavity, and an electromechanical transducer mounted in mechanical communication with said ink cavity, a source of electrical pulses repeatable at a drop-on-demand drop production rate, and means to selectively actuate said electromechanical transducer in response to said electrical pulses to force an ink droplet from said orifice; the method comprising the steps of:

producing successive electrical pulses with a controlled delay time between said successive electrical pulses, said delay time being short with respect to said drop-on-demand drop production rate; and actuating said electromechanical transducer with each of said electrical pulses to produce a droplets having a controlled size from said orifice, said ink droplets merging into a single drop of ink prior to the time the drop reaches the print medium for printing whereby each ink drop can be produced having range of control of drop sizes.

* * * * *

UNITED STATES PATENT AND TRADEMARK OFFICE
CERTIFICATE OF CORRECTION

PATENT NO. : 5,285,215

DATED : February 8, 1994

INVENTOR(S) : Stephen J. Liker

It is certified that error appears in the above-identified patent and that said Letters Patent is hereby corrected as shown below:

Column 9, Line 25, after "producing" add --a--.

Column 9, Line 37, after "a" change "crop-on-demand" to --drop-on-demand--.

Signed and Sealed this

Twentieth Day of September, 1994

Bruce Lehman

*Attest:*

BRUCE LEHMAN

*Attesting Officer*

*Commissioner of Patents and Trademarks*